United States Patent [19]

Lotte

[11] 4,063,501

[45] Dec. 20, 1977

[54] ADJUSTABLE MODULAR ROTARY SCREEN MOUNT

[75] Inventor: André Lotte, Mulhouse, France

[73] Assignee: Societe Alsacienne de Mecaniques de Mulhouse, Mulhouse Cedex, France

[21] Appl. No.: 705,783

[22] Filed: July 16, 1976

[30] Foreign Application Priority Data

Sept. 30, 1975 France ..... 75.29853

[51] Int. Cl.[2] ..... B41F 15/38

[52] U.S. Cl. ..... 101/128.1; 101/115

[58] Field of Search ..... 101/115, 116, 127.1, 101/128.1, 248, 247, 364

[56] References Cited

U.S. PATENT DOCUMENTS

| | | | |
|---|---|---|---|
| 2,967,480 | 1/1961 | Gerard | 101/364 |
| 3,572,240 | 3/1971 | Böhm | 101/116 |
| 3,834,307 | 9/1974 | Zimmer | 101/127.1 X |
| 3,837,277 | 9/1974 | Jaffa et al. | 101/127.1 |
| 3,892,177 | 7/1975 | Giani | 101/116 |
| 3,921,519 | 11/1975 | Zimmer | 101/116 |
| 3,926,111 | 12/1975 | Böhm | 101/116 |

FOREIGN PATENT DOCUMENTS

| | | | |
|---|---|---|---|
| 546,145 | 2/1974 | Switzerland | 101/127.1 |

*Primary Examiner*—E. H. Eickholt
*Assistant Examiner*—R. E. Suter
*Attorney, Agent, or Firm*—Holman & Stern

[57] ABSTRACT

A removable module carrying a screen for a rotary screen printing machine, which stands on four individually vertically adjustable legs, each supported on an individual seating surface mounted on a bedplate. Two screw spindle and movable cylinder-nut mechanisms are provided for in-place angular and transverse position adjustment. The rotational drive of the screen is provided through a slidable Cardan joint.

8 Claims, 7 Drawing Figures

ADJUSTABLE MODULAR ROTARY SCREEN MOUNT

The invention is concerned with machines with rotary screens for the printing of articles in strip form.

The screens are thin metal tubes, generally of nickel, the wall of which has perforations corresponding to the design to be printed and at the interior of each of which is disposed a metal squeegee the function of which is to force the colour to pass through the perforations in the screen; this squeegee is fast with adjustment and pressure mean located externally of the screen.

In the standard machines, all of the means for adjustment and control of the screen and of the squeegee are fast with the machine substructure of which they form an integral part. This arrangement presents a disadvantage as, when printing has ended and the screens must be changed in order to bring about a new design, it is necessary to take out separately first of all the squeegee, by pulling it out in the lateral direction, and then the screen, after having released them from the means fastening same in place, and adjusting and controlling same.

It is clear that this procedure complicates the printer's work, as it necessitates difficult working which requires care and ability. Moreover, the consequence is a considerable waste of time and the machine can not provide any production for a fairly long space of time, often estimated at between 30 and 40 minutes.

The object of the present invention is to realize a printing machine with rotary screen of a different design which does not have the above mentioned disadvantage of the standard machines.

To this end, in the machine according to the invention, each screen belongs to a removable module which includes means for positioning same in the machine, means for supporting the screen, means for supporting the squeegee, and means for rotating the screen through a transmission which includes a driven part supported by said module and capable of meshing with a driving part supported by the bedplate of the machine.

Thanks to such a design, each printing module can be set up in and removed from the machine by means of an ordinary lifting appliance. Thus, when a printing operation is complete, all of the modules in use can be removed in a very short time and immediately replaced by different modules made ready outside the machine and pre-adjusted.

It is therefore clear that this procedure represents a positive advance for the printer, as the latter will no longer have to go ahead, on the machine itself, with the difficult work which consists in taking out the squeegees and the screens covered with colour. Someone can be specially assigned to this work, in a place specially fitted up for the dismounting of the screens and the squeegees. It is clear that there will also be a considerable reduction in the unproductive periods, as the setting up of the new modules prepared and pre-adjusted with their screens for new designs could immediately follow the removal of the former modules with the screens printing of the design of which has been completed.

The invention will be better understood on reading the description about to follow and on examination of the accompanying drawings which show, by way of example, one embodiment of a printing machine according to the invention with removable modules.

Figure 1:
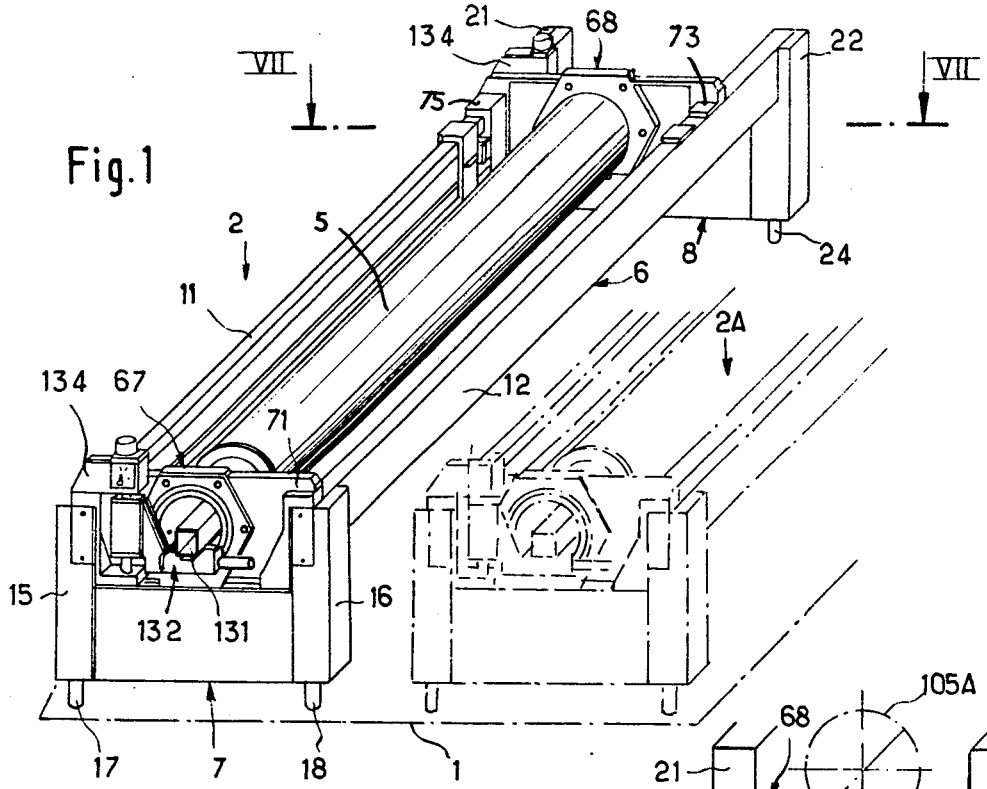
FIG. 1 is a simplified perspective view of the whole of a printing module.

The machine for printing strip materials, the bedplate of which has been simply indicated at 1 in FIG. 1, includes several interchangeable removable printing modules such as 2.

The beginning of the outline of another module 2A, set at the side of the first, has been indicated in dot-dash lines, the machine possibly including any desired number of printing modules.

Each printing module, such as 2, essentially includes a rotary screen 5 supported by a base which is designated 6 in its entirety and which is made up of two cradles 7, 8 interconnected by two cross bars 11, 12. The cradle 7 is located at the service side of the machine and the cradle 8 is located at the opposite side. The central part of the two cradles is in the form of a basin 9 (See FIG. 5) which can receive colour overflows and direct the latter through an outflow duct 10 towards the exterior or the interior of the machine.

Figure 2:
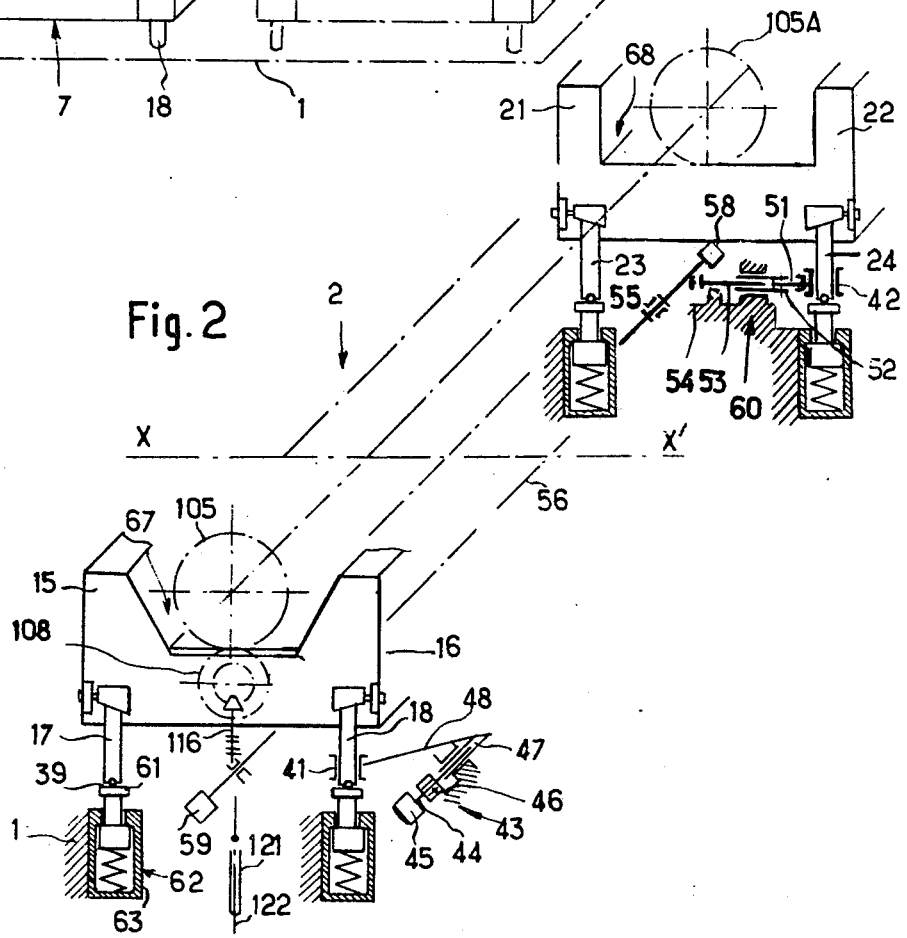
FIG. 2, is likewise in perspective, a diagrammatic view of the printing module and of its supporting means as well as of the transmission set-up for rotating the screen.

The cradle 7 is provided with two posts 15, 16 in which are mounted two height adjustable legs 17, 18, respectively, and, in a similar manner, the other cradle 8 is provided with two posts 21, 22 in which are likewise mounted two height-adjustable legs (see also FIG. 2). The entire removable module 2 thus stands on the bedplate 1 of the machine through its four legs 17, 18, 23 and 24.

Figure 4:
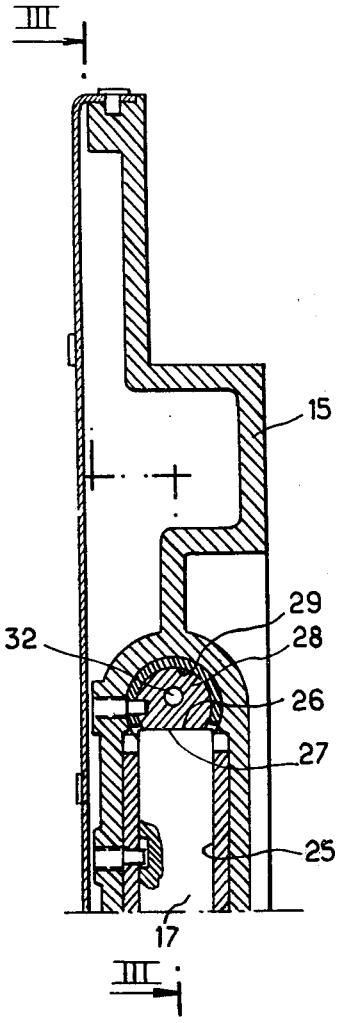
FIG. 4 is a section along the line IV—IV of FIG. 3.
Figure 3:
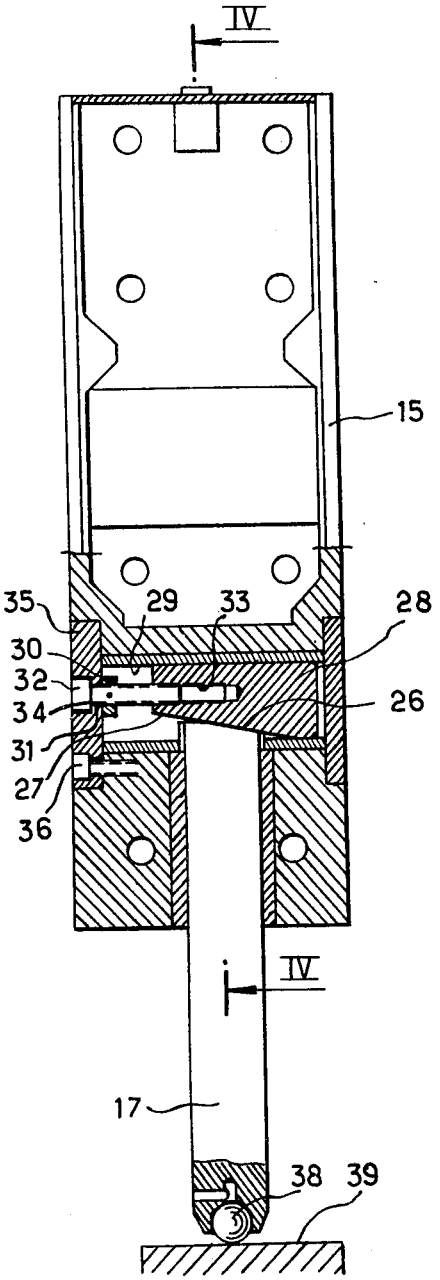
FIG. 3 is, on a larger scale, a view of one of the modules-supporting legs, in section along the line III—III of FIG. 4.

Each leg, for example the leg 17 (see also FIGS. 3 and 4), is made up of a vertical cylindrical shank which can slide in a guide 25 of the post 15 and the upper end of which terminates in a plane surface 26 slightly inclined in relation to the horizontal and against which bears a conjugate plane surface 27 belonging to a wedge 28 of generally cylindrical shape which can slide in a horizontal guide 29 secured in post 15 under the action of an adjusting screw 32 engaged in a tapped horizontal hole 33 in said wedge and which can turn freely, without axial displacement, in a hole 31 in a plate 35 fixed to the post 15 by screws 36. The screw 32 is held back axially, in one direction, by a shoulder 34 on the plate 35, against which its head bears and, in the other direction, by a washer 30 pinned on to said screw and bearing against the inside surface of the plate 35. In the lower end of the leg 17 is set a small ball 38 which ensures a very precise bearing of the module on the seating surface 39 on which the ball rests and which is fastened to the bedplate 1 of the machine.

The three other legs 18, 23 and 24 are mounted in the same way as the leg 17 and, consequently, are also adjustable individually on height.

In order to position the module 2 with precision in the bedplate of the machine, both in the direction transverse to the longitudinal axis XX¹ of the machine (FIG. 2) and angularly in relation to the axis in order that the axis of the screen 5 is indeed perpendicular to the axis XX¹, two module-supporting legs, for example the legs 18 and 24, can slide freely in two collars 41, 42 respectively, subject to the action of adjustment means in a horizontal plane. The collar 41 is connected to the adjustment means which as a whole is denoted 43 and which includes a screw 44 provided with a manually-operable control knob 45 and capable of turning freely, without axial displacement, in a block 46 fast with the bedplate 1 of the machine, while an internally screw thread sleeve 47, engaged through its threads on said screw, is mounted for longitudinal sliding movement in said block, without being capable of turning upon itself, and it is united as one with the collar 41 through a connection indicted at 48.

The screw 44 is parallel to the axis of the screen 5, so that, when the knob 45 is turned in one or the other direction, the whole module is displaced transversely to the longitudinal axis XX¹ of the machine.

The other collar 42 is connected through a link 51 to an internally screw threaded sleeve 52 engaged through its threads on a screw 53 extending parallel to the axis XX¹ and turning, without axial displacement, in a block 54 fast with the bedplate of the machine. The screw 53 is connected, through a bevel gearing 55, with a transverse rotary control rod 56 which also turns on the bedplate of the machine and which is provided, at each of its ends, with an adjustment control knob 58, 59. By turning the control rod 56 of this other adjustment means 60, in one or the other direction, the leg 24 is advanced or withdrawn in the direction of the longitudinal axis X-X¹ of the machine, which enables placement of the screen in such manner that its axis is in a direction strictly at right angles to the longitudinal axis of the machine.

Given that the two legs 18, 24 can slide freely up and down in the adjustment collars 41, 42, these latter do not in any way impede the removal of the module in an upwards direction or the putting of same into place.

The four seating surfaces, such as 39 (FIG. 3), on which the four legs of the cradles respectively stand, may be lowered into the working position or on the contrary, raised when it is desired to clear the screen from the work-table 49 (FIG. 6) over which slides the belt 50 intended to support the strip to be printed. To this end, these seating surfaces pertain, for example, to the moveable member 61 (FIG. 2) of a pneumatic jack 62 the fixed member 63 of which is fast with the bedplate 1 of the machine.

The ends of the screen 5 (FIG. 1) are supported in two heads 67, 68 themselves fixed on bearers mounted on the crosbars 11, 12. In FIG. 1, there can be seen one such bearer 71 on which one side of the head 67 is fixed by means of screws 72 (see also FIG. 5) as well as a bearer 73 on which is fixed the corresponding side of the other head 68. The bearer 71 is fixed immovably on the crossbar 12, while the bearer 73 is mounted for sliding movement on the latter. The other side of the head 68 rests on another bearer 75 which can slide on the crossbar 11. In a similar manner, the other side of the head 67 rests on a bearer (not visible in FIG. 1) fixed immovably on the crossbar 11.

The screen 5 is stuck on a ferrule 77 (FIG. 6) mounted in a removable manner, by any suitable means, on one end of a collar 78 in such a manner as to be capable of being made perfectly fast with the latter. The collar 78 is journalled in the head 67 through two ball or like bearings 81, 82. The other end of the screen 5 is stuck, through a similar fitment, on a ferrule 84 (FIG. 7) fixed, in a removable manner, on the end of a collar 85 which is journalled in the other printing head 68. The screen may be stretched longitudinally by means of two pneumatic jacks 91, 92 (FIG. 7) whereof the cylinders 93, 94 are fixed respectively to the crossbars 11, 12 and whereof the piston rods 95, 96 rest against carriages 97, 98 which slide respectively on the two crossbars and have grooves 101, 102 in which the two sides of the head 68 are tightly held. When compressed air is passed into the two jacks 91, 92, the piston rods 95, 96 thereof are urged outwardly, so that they push back the carriages 97, 98 and, consequently, the head 78 which supports the ferrule 84 on which the screen 5 is fixed whereby the latter is put under tension.

In the embodiment shown, the screen is rotated through one of its ends. To this end, the collar 78 (FIG. 6) carries a toothed wheel 105 made rotationally fast with this collar by two diametrically opposed keys 106, the toothed wheel 105 is in mesh with another toothed wheel 108 carried by a shaft 109 which is journalled, by means of two bearings 111, 112 in a gearbox 113 fast with the head 67. The shaft 109 also carries a bevel gear 114 in mesh with another bevel gear 115 fixed on a shaft 116 which is also journalled in the gearbox 113, through two roller bearings 117, 118 and which emerges at the lower end of said gear box so as to be connectible, through a sliding cardan shaft 121 (see also FIG. 2), to a vertical control shaft 122 set in the bedplate of the machine.

Figure 5:
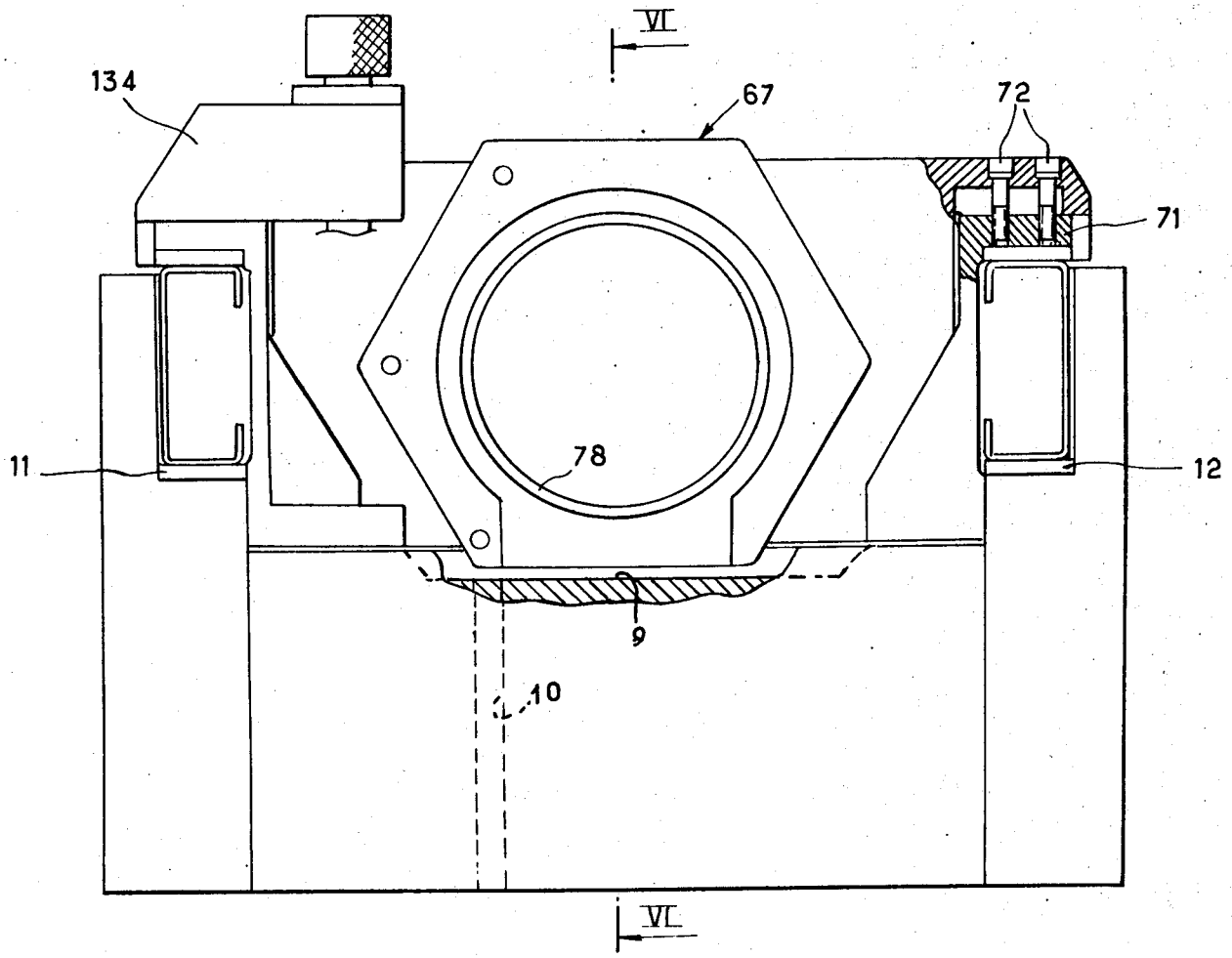
FIG. 5 shows, on a larger scale, the cradle on the service side of the module.
Figure 6:
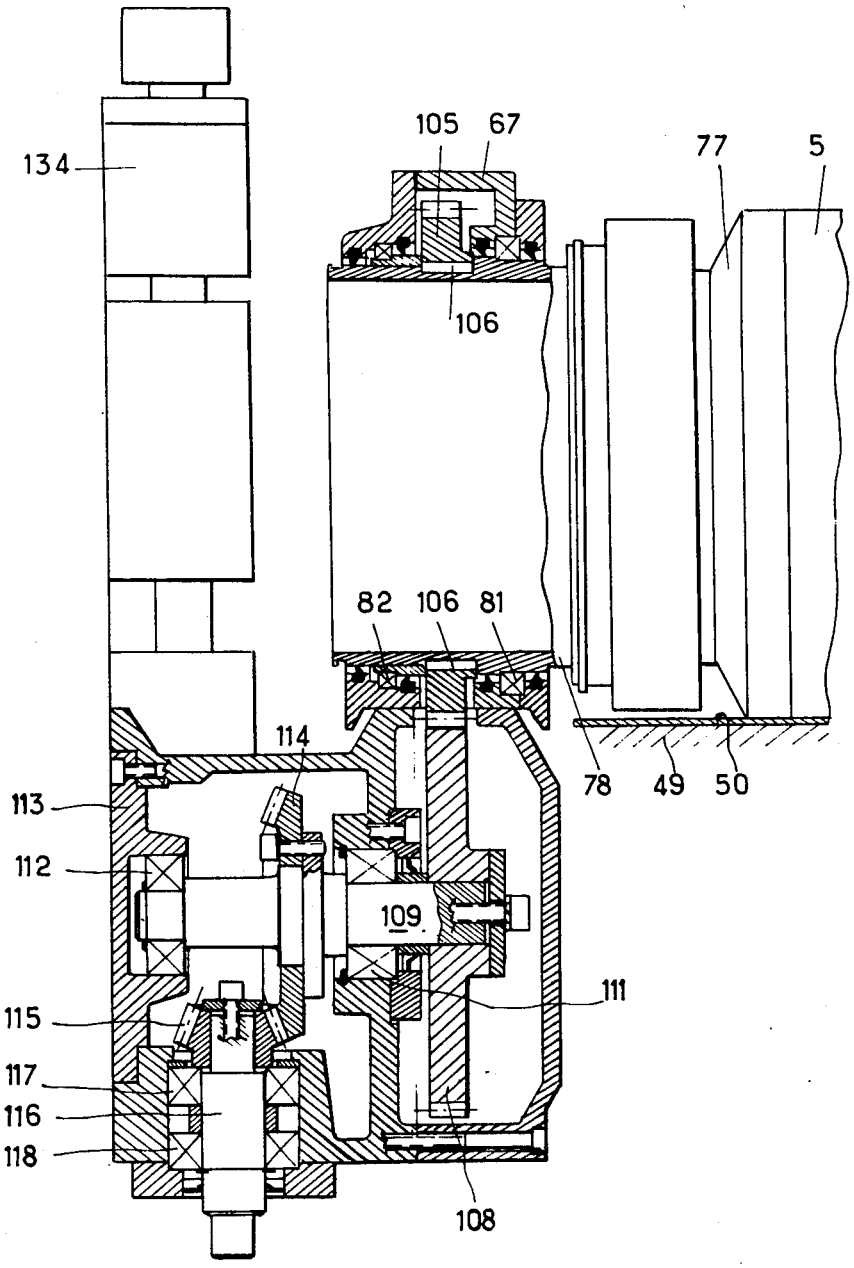
FIG. 6 is a section made along the line VI—VI of FIG. 5.
Figure 7:
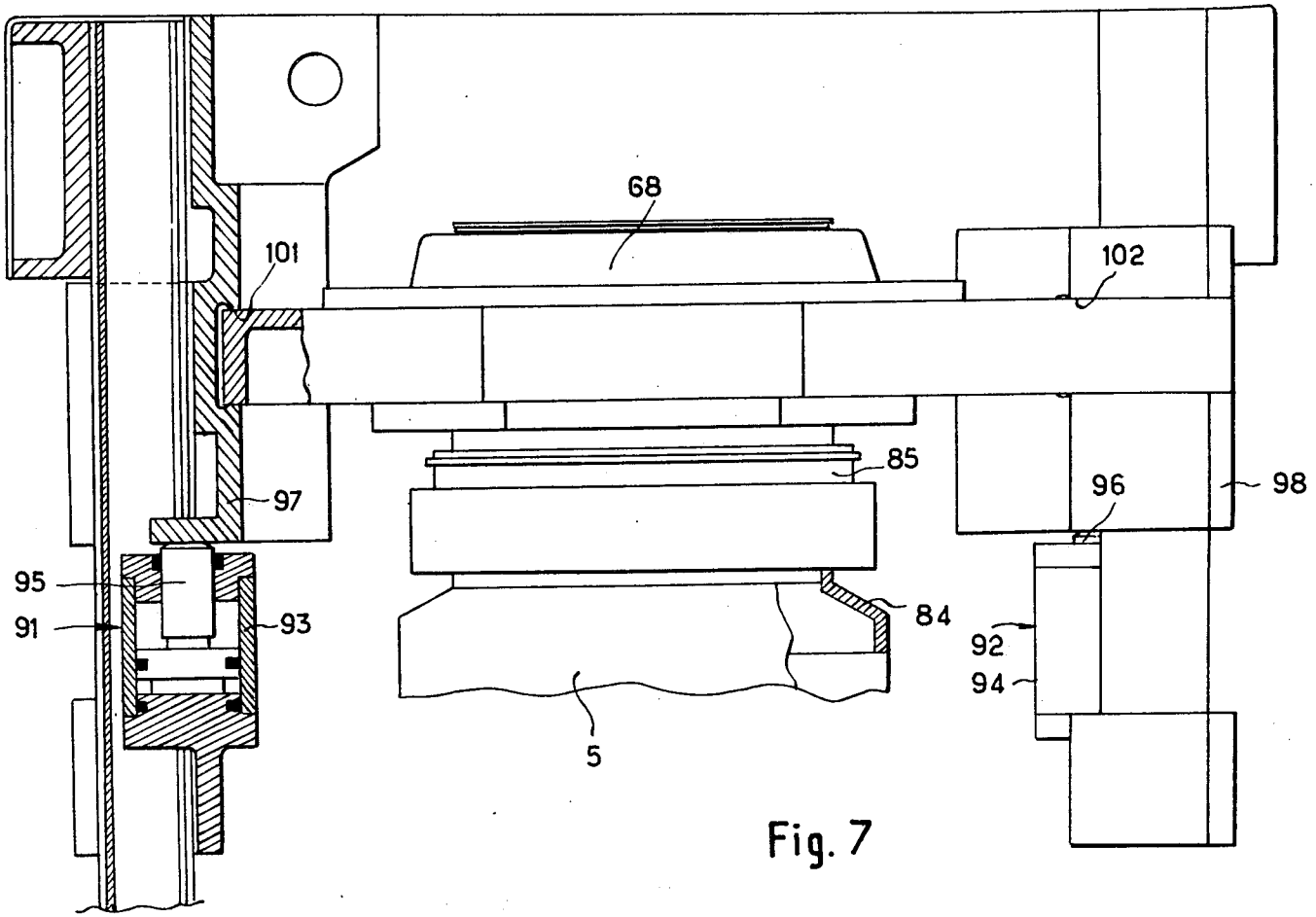
FIG. 7 shows, also on a larger scale, the cradle of the module on the side opposite to the service side, in horizontal section made along the line VII—VII of FIG. 1.

The squeegee (not visible in the drawings) arranged internally of the rotary screen 5 is supported by a tube 131 (FIG. 1) itself borne, at each of its ends, by support means denoted in its entirety by 132, of any suitable kind, enabling adjustment as well as rapid removal and putting into place of the squeegee holder. The support means 132 is itself carried by a bearer 134 fast with the corresponding head 67 or 68 (FIGS. 1, 5 and 6).

The manner of operation of the machine is the following:

Each printing module, such as 2 or 2A, is autonomous; it stands on the bedplate 1 of the machine through its four height-adjustable legs 17, 18, 23, 24 and it can be adjusted transversely and trued-up by the displacement of the collars 41, 42 (FIG. 2). The screen is rotatively driven from the control shaft 122 mounted in the machine and providing with the sliding cardan linkage 121. The printing module may be set into place in and removed from the machine by a simple lifting device, since it simply stands, through its four legs, on the bedplate of the machine and since the cardan linkage is made up of two members which can slide one within the other.

Naturally, the invention is not restricted to the embodiment described and shown; modifications may be introduced thereinto, in accordance with the applications contemplated, without departing from the scope of the invention.

I claim:

1. A rotary screen printing machine having a longitudinal axis for the printing of articles in strip form extending in the direction of said axis, said machine comprising a bedplate and at least one removable printing module carried on said bedplate; each said printing module comprising: a base; means for rotatably supporting respective ends of a cylindrical screen, said screen having a screen axis; screen-driving means for rotatably driving said screen, said screen-driving means having a module-borne connecting member; means for supporting a squeegee-carrier; first, second, third and fourth vertical legs mounted in said base for vertical adjustment with respect thereto and each having a lower end, said first and second legs being located on one side of said longitudinal axis of the machine while said third and fourth legs are located on the other side of said axis of the machine; and individual means in said base for vertically adjusting each of said legs; said machine bed-plate comprising: even horizontal seating surfaces supporting said lower ends of said legs of said printing module with the said screen axis extending in a direction transverse to said longitudinal axis of the machine; guiding means for permanently preventing said first leg located on one side of said machine axis from moving in the direction of said axis of the machine; angular adjusting means for horizontally adjusting the position of one of said third and fourth legs with respect to the corresponding said seating surface in a direction parallel with the direction of said longitudinal axis of the machine; said guiding means including transverse adjusting means for horizontally adjusting the position of said first leg with respect to the corresponding said seating surface in a direction transverse to said longitudinal axis of the machine; and a rotating driving part operatively engageable with said module-borne connecting member for driving said rotary screen.

2. The machine as set forth in claim 1, wherein said guiding means and transverse adjusting means are formed together by a first collar freely mounted on said first leg and a first screw-and-nut connection extending in a direction transverse to said machine axis said first screw-and-nut connection comprising a first and second screw-threaded parts the screw threads of which are engaged in each other, said first screw-threaded part being secured to said collar and mounted in said bed-plate for axial sliding movement and being prevented from rotation therein, said second screw-threaded part being mounted in said bed-plate for rotational movement and being prevented from moving axially, a first manually operable member being secured to said second screw-threaded part; said angular adjusting means being formed by a second collar freely mounted on said one of said third and fourth legs and a second screw-and-nut connection extending in a direction parallel with said machine axis, said second screw-and-nut connection comprising a third and fourth screw-threaded parts the screw threads of which are engaged in each other, said third screw-threaded part being linked to said collar and mounted in said bed-plate for axial sliding movement and being prevented from rotation therein, said fourth screw-threaded part being mounted in said bed-plate for rotational movement and being prevented from moving axially, a second manually operable member being operatively connected to said fourth screw-threaded part.

3. The machine as set forth in claim 1, wherein said module-borne connecting member and said rotating driving part engageable therewith for driving said rotary screen are comprised, respectively, by two relatively sliding members of a conventional Cardan joint.

4. The machine as set forth in claim 1, wherein said base of said printing module comprises two cradles and two cross-bars interconnecting said two cradles while said means for rotatably supporting said rotary screen comprises two heads which are supported by said cross-bars.

5. The machine as set forth in claim 4, wherein one of said two heads is rigidly fixed on said cross-bars while the other is adjustable along said cross-bars.

6. The machine as set forth in claim 5, further comprising resilient means carried by said cross-bars for urging said adjustable head away from said fixed head to make said screen taut.

7. The machine as set forth in claim 1, further comprising raising means carried by said bed-plate for raising and lowering said even horizontal seating surfaces supporting said lower ends of said legs.

8. The machine as set forth in claim 4, wherein each cradle has a dish-shaped bottom provided with an overflow duct.

* * * * *